US005794995A

United States Patent [19]

Creesy et al.

[11] Patent Number: 5,794,995

[45] Date of Patent: Aug. 18, 1998

[54] PIVOTABLE AND ROTATABLE DOOR LOCK BUTTON ASSEMBLY

[75] Inventors: Robin C. Creesy, Westland; Conrad F. Hempel, Farmington Hills, both of Mich.

[73] Assignee: Ford Global Technologies, Inc., Dearborn, Mich.

[21] Appl. No.: 506,714

[22] Filed: Jul. 26, 1995

[51] Int. Cl.[6] ..... E05B 3/00

[52] U.S. Cl. ..... 292/348; 292/DIG. 63; 292/354

[58] Field of Search ..... 292/347, 336.3, 292/DIG. 2, 1, DIG. 63, 354, 352, 348; 403/113, 116, 117, 294, 396, 397

[56] References Cited

U.S. PATENT DOCUMENTS

| | | | |
|---|---|---|---|
| 3,003,803 | 10/1961 | Kirk . | |
| 3,247,691 | 4/1966 | Martin | 292/DIG. 2 |
| 3,408,836 | 11/1968 | Trammell, Jr. | 292/347 |
| 3,558,168 | 1/1971 | Andres | 292/247 |
| 3,623,758 | 11/1971 | Trinca . | |
| 3,666,308 | 5/1972 | Bonnaud . | |
| 3,719,378 | 3/1973 | Windsor . | |
| 3,782,140 | 1/1974 | Price . | |
| 3,838,876 | 10/1974 | Haven | 292/1 |
| 3,865,437 | 2/1975 | Crosby . | |
| 4,098,529 | 7/1978 | Bingham . | |
| 4,238,133 | 12/1980 | Trammell, Jr. . | |
| 4,415,192 | 11/1983 | Kodama et al. | 292/347 |
| 4,606,567 | 8/1986 | Kato et al. . | |
| 4,674,780 | 6/1987 | Weinerman et al. . | |
| 4,698,858 | 10/1987 | Kostorz | 4/192 |
| 4,793,640 | 12/1988 | Stewart, Jr. . | |
| 4,813,727 | 3/1989 | Mills . | |
| 4,835,816 | 6/1989 | Graef . | |
| 4,842,312 | 6/1989 | Iwasaki et al. | 292/336.3 |
| 4,899,614 | 2/1990 | Kataumi . | |
| 5,161,876 | 11/1992 | Smith | 362/66 |
| 5,415,491 | 5/1995 | Hayakawa et al. . | |

*Primary Examiner*—Steven N. Meyers
*Assistant Examiner*—Gary Estremsky
*Attorney, Agent, or Firm*—David B. Kelley

[57] ABSTRACT

An automotive vehicle door (10) has a door lock mechanism (18) mounted therein which is mechanically operated by a door lock button assembly (24) between a lock position and an open position. The door lock button assembly (24) has a control rod (28) connected on one end (32) to the door lock mechanism (18) and is non-threadingly retained on the other end (34) to a button member (26) so as to permit the control rod (28) to pendulumingly swing a predetermined angle (β) with respect to the longitudinal axis (50) thereof and to allow the button member (26) to rotate around the longitudinal axis (50) so as to prevent binding when moving through an opening (45) in a trim panel (12) of the vehicle door (10).

11 Claims, 2 Drawing Sheets

PIVOTABLE AND ROTATABLE DOOR LOCK BUTTON ASSEMBLY

FIELD OF THE INVENTION

The invention relates generally to vehicle door lock mechanisms and, more particularly, to a door lock button assembly which permits pivotable and rotatable movement of the door lock button with respect to a control rod.

BACKGROUND OF THE INVENTION

Automotive vehicle doors typically contain a door lock mechanism mounted in an interior space between an outer door panel and a trim panel. The door lock mechanism is movable between a locked position, thereby preventing the door from opening, and an unlocked position, which allows the door to be opened with a door handle either on the door outer panel or on the trim panel. Additionally, vehicle doors are known having a door lock button threaded to a control rod which extends into the interior space and connects with the door lock mechanism. The door lock button extends through the trim panel and allows an operator to position the control rod in a first position depressed toward the surface, or sill, of the trim panel, and a second position away from the sill. In the first position, the control rod conventionally positions the door lock mechanism to lock the vehicle door, and in the second position, the control rod positions the door lock mechanism to the open position.

Heretofore, the door lock button has been threaded onto an end of the control rod, as seen in U.S. Pat. No. 4,674,780 (Weinerman, et al.), U.S. Pat. No. 4,098,529 (Bingham), and U.S. Pat. No. 4,238,133 (Trammell, Jr.). Although door lock button designers have been preoccupied with anti-theft concerns, scant attention has been paid to the need for a smoothly operating door lock button. The aforedescribed method of attachment, using threads, has the disadvantage of not allowing the control rod to pivot or swing with respect to the door lock button. Since the door lock button is mounted on the control rod so as to move vertically in an axis therealong, build tolerances of the vehicle door, particularly with respect to attachment of the trim panel and the opening through which the door lock button will move, may result in binding and sticking of the door lock button. This results since the control rod is commonly attached to a lever extending from the door lock mechanism. The lever, in turn, translates generally vertical motion of the control rod into the lock and unlock positions previously described, which may require translation to motion having a horizontal component. Movement of the lever is not typically in a precisely vertical direction, but usually travels through a small angle when moving between the lock and unlock positions. As such, the end of the control rod attached to the door lock mechanism lever typically portends an arc with respect to the attachment point on the door lock button.

A further disadvantage of prior door lock button attachments is failure to allow rotation of the door lock button with respect to the control rod. Threaded attachment of the door lock button to the control rod may result in the door lock button being misaligned with the opening in the trim panel when securely screwed onto the control rod. As such, movement of the door lock button through the opening results in binding, particularly with non-circularly shaped door lock buttons.

SUMMARY OF THE INVENTION

The present invention overcomes the disadvantages of the related art by providing a door lock button assembly in which the control rod is pivotally and non-threadingly attached to the door lock button to permit the control rod to pendulumingly swing a predetermined angle with respect to the door lock button and to allow the button to rotate around the longitudinal axis of the control rod so as to prevent binding when passing through the trim panel. The control rod has a first end mechanically connected to a door lock mechanism for effecting a change in the door lock mechanism between the lock position and the unlock position when the control rod is moved between a first position and a second position, respectively. On the second end of the control rod is a retainer, preferably frusto-conically shaped, which fits in non-threaded relationship into a cavity in a shoulder portion of the door lock button to allow the control rod to pivot thereabout and to allow the button to rotate thereabout.

Preferably, the button has a sleeve extending from the cavity with a frusto-conically shaped groove therethrough which receives a portion of the second end of the control rod therein so as to limit the amount of swivel with respect to the retainer. The sleeve preferably has a longitudinal slot extending therealong with a width less than the diameter of the control rod, the cavity also having an orifice opening into a surface of the shoulder so that the control rod and the retainer attach thereto in snap-fit relationship. The sleeve is so shaped, as to allow the control rod to pivot approximately between 2°–5°, and preferably approximately 3°.

An advantage of the present invention is a door lock button assembly which prevents binding of the door lock button when moving through a grommett or opening in the trim panel.

Another advantage is a door lock button assembly which is inexpensive to manufacture and easy to install.

Still another advantage is a door lock button than does not require tapping threads therein.

A feature of the present invention is a door lock button which nonthreadingly attaches to a control rod and allows rotatable movement around the axis thereof.

Another feature is a door lock button assembly in which the control rod is pivotally mounted to the door lock button on one end so that the other end, attached to the door lock mechanism, may pendulumingly swing a predetermined angle when moving between a first position wherein the door is locked, and a second position wherein the door is unlocked.

BRIEF DESCRIPTION OF THE DRAWINGS.

Other objects, features, and advantages of the door lock button assembly according to the present invention will be apparent to those skilled in the automotive body arts upon reading the following description with reference to the accompanying drawings in which.

DETAILED DESCRIPTION OF THE PREFERRED EMBODIMENT

Figure 1:
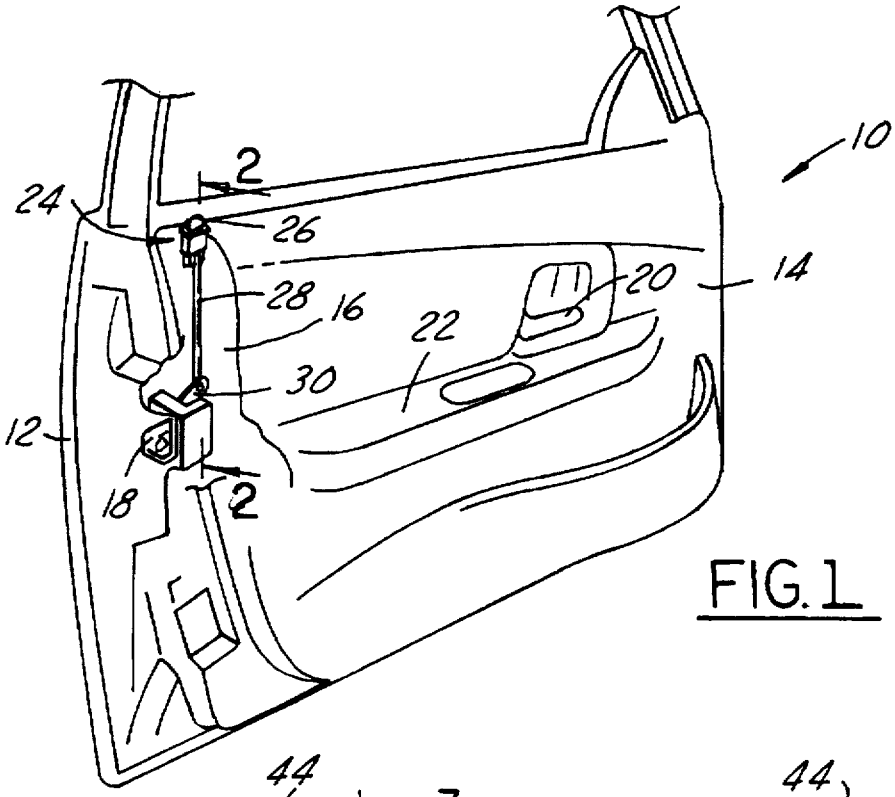
FIG. 1 is a perspective inside view of a vehicle door shown in partially cutaway section, having a door lock mechanism mounted therein with a door lock button assembly according to a preferred embodiment of the present invention.

Turning now to the drawings, and in particular to FIG. 1 thereof, a vehicle door 10 is shown having an outer panel 12 with a trim panel 14 connected on an inner side, with an interior space 16 therebetween, as seen in partially cutaway section. With in in the interior space 16 is conventionally mounted a door lock mechanism 18 for positioning a door lock between a locked position whereby the vehicle door 10 is not able to be opened, and an open position, wherein the vehicle door 10 can be swung open upon unlatching, for example, with a do or handle 20. The door lock mechanism 18 can be electronically controlled, for example, with a switch (not shown) on an armrest portion 22 of the trim panel 14, or mechanically through a door lock button assembly 24. The door lock button assembly 24 comprises a door lock button member 26 and a control rod 28 attached to a lever 30 of the door lock mechanism 18.

Figure 2:
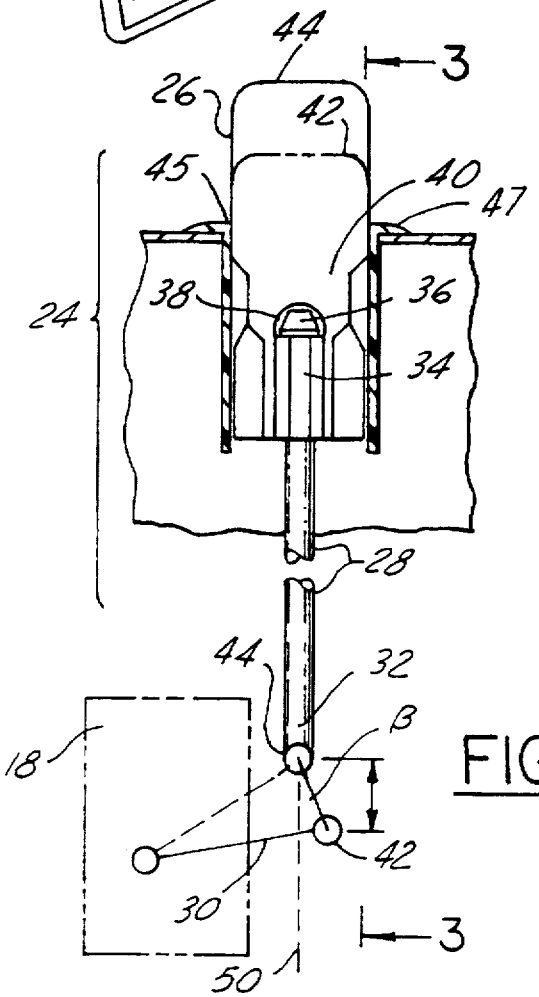
FIG. 2 is a front view, shown in partial cross-section, of a door lock button assembly taken along line 2—2 of FIG. 1.
Figure 3:
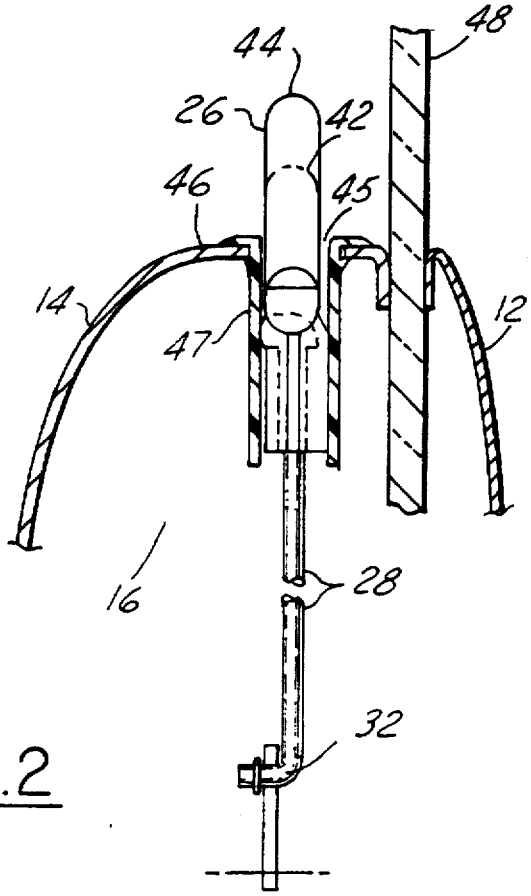
FIG. 3 is a view taken along line 3—3 of FIG. 2.

Turning now to FIGS. 2 and 3, a door lock button assembly 24 according to the present invention is shown. A control rod 28 has a first end 32 mechanically connected to the lever 30 of the door lock mechanism 18, and a second end 34 with a retainer 36 thereon fitted into a cavity 38 in a shoulder portion 40 of the button member 26. An operator of the door lock button assembly 24, for example, a passenger or driver of the vehicle, can move the control between a first position 42 in which the door lock mechanism 18 is in the lock position, and a second position 44 in which the door lock mechanism 18 is in the open position, by grasping the button member 26 and moving it generally vertically up or down as required. For purposes of this disclosure, the terms "up," "down," "upper," "lower," and other terms of direction will be with reference to FIG. 2.

Still referring to FIGS. 2 and 3, it will be seen that the button member 26 of the door lock button assembly 24 protrudes through an opening 45 in a sill section 46 of the trim panel 14, typically adjacent a door glass panel 48. Within the opening 45 is mounted a grommet 47 to improve trim appearance and facilitate movement of the door lock button 26 therethrough. Movement of the control rod 28 between the first position 42 and the second position 44, so as to move the lever 30 of the door lock mechanism 18 results in an angular movement, designated as β (FIG. 2), with respect to a vertical axis 50 generally longitudinally along the axis of the control rod 28. The retainer 36 is fitted into the cavity 38 in non-threading relationship so as to permit the control rod 28 to pivot thereabout and to pendulumingly swing through the angle β.

Figure 5:
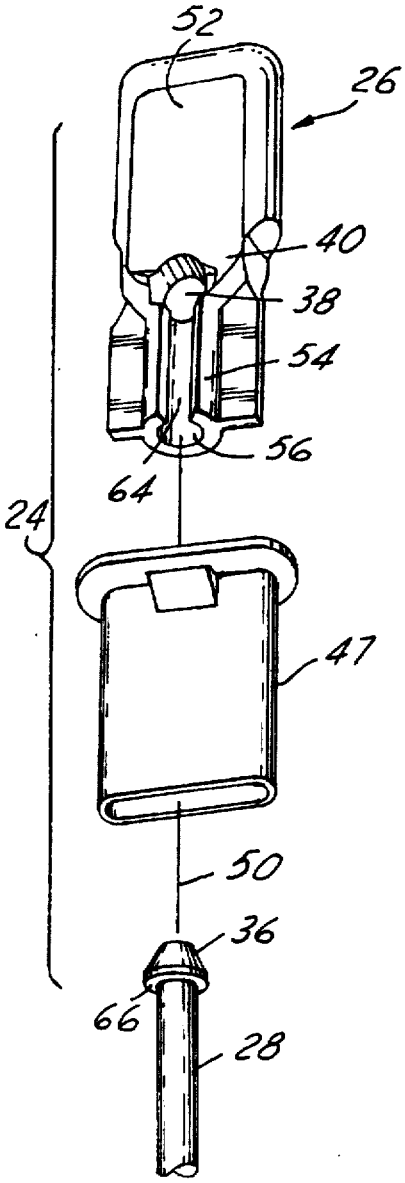
FIG. 5 is an exploded perspective view of a door lock button assembly according to a preferred embodiment of the present invention.
Figure 4:
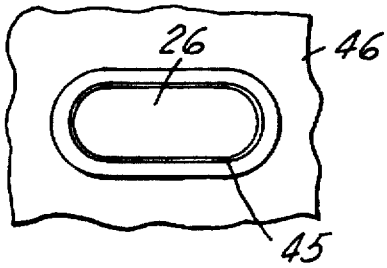
FIG. 4 is a top view of a door lock button assembly according to the present invention.
Figure 6:
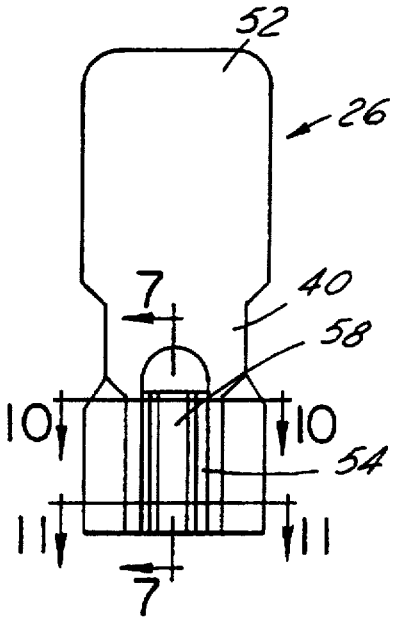
FIG. 6 is a back view of a door lock button according to the present invention.
Figure 7:
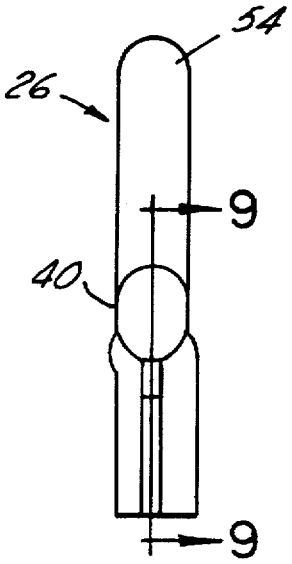
FIG. 7 is a side view of the door lock button shown in FIG. 6.
Figure 9:
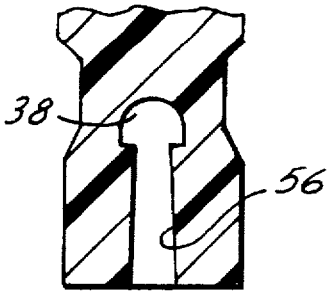
FIG. 9 is a cross-sectional view taken along line 9—9 of FIG. 7.
Figure 10:
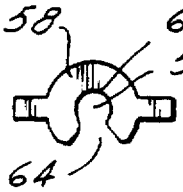
FIG. 10 is a cross-sectional view taken along line 10—10 of FIG. 6.
Figure 11:
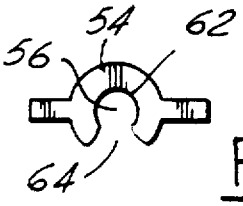
FIG. 11 is a cross-sectional view taken along line 11—11 of FIG. 6.

As seen in FIGS. 4 and 5, the button member 26 has a generally rectangularly shaped button portion 52 (FIG. 5) with an oval shaped cross-section (FIG. 4) to allow an operator to grasp a surface thereof to move the control rod 28 between the first and second positions. The shoulder portion 40 of the button member 26 has the cavity 38 therein with a sleeve 54 extending therefrom. The sleeve 54 has a frusto-conically shaped groove 56 therethrough, as best seen in FIGS. 9–11, for receiving a portion 58 of the second end 34 of the control rod 28. The frusto-conical shape of the groove 56 is tapered so as to allow the control rod 28 to pivot approximately between 2°–5° from the vertical axis 50, and preferably allows approximately 3° of swivel with respect thereto. To allow such a swivel, a narrower end 60 of the groove 56 (FIG. 10) is placed near the cavity 38 (FIG. 9), and a wider end 62 of the groove 56 (FIG. 11) is opposite the cavity 38 (FIG. 9).

The sleeve 54 preferably has a longitudinal slot 64 extending therealong with a width less than the diameter of the control rod 28, the control rod 28 attaching to the button member 26 through the slot 64 in snap-fit relationship.

Figure 8:
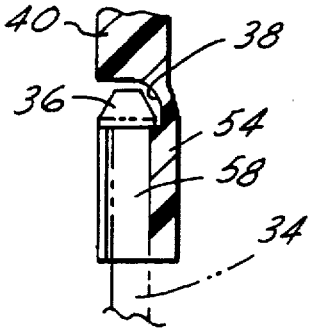
FIG. 8 is a partial cross-sectional view taken along the line 8—8 of FIG. 6.

The retainer 36 is preferably frusto-conically shaped with a base 66 having a circumference larger than that of the circumference of the control rod 28, and larger than the circumference of the narrower end 60 of the groove 56, so as to prevent the retainer 36 from sliding axially through the groove 56 (FIGS. 5 and 8). It should be noted that the frusto-conical shape of the retainer 36 allows the button member 26 to rotate around the longitudinal axis of the control rod 28 so as to prevent binding with the grommet when moving therethrough between the first and second positions. Since prior practice has been to screw the button onto a threaded portion of the control rod 28, prior buttons would occasionally bind when the trim panel 14 was not correctly attached to the door so that the opening therein would not correctly align with the orientation of the button member 26 on the control rod 28. The present invention overcomes that potentiality by allowing the button member 26 to rotate around the longitudinal axis of the control rod 28 on the retainer 36 to correctly align with the orientation of the grommet in the trim panel 14.

The button member 26 is preferably injection molded of a durable plastic material, such as acetal, with the cavity 38, the sleeve 54, and the groove 56 molded as a single piece. The button member 26 is then snapped onto the control rod 28, obviating the prior need for accurate alignment of the button member 26 within the grommet during vehicle door 10 assembly. Also obviated is the need for tapping threads into the button member, an expensive and time consuming process. The control rod 28 preferably has the retainer 36 upset onto the end 34 so that the rod 28 and the retainer 36 are of a single piece made of the same material, which preferably is metal.

Although the preferred embodiment of the present invention has been disclosed, various changes and modifications may be made thereto by one skilled in the art without departing from the scope and spirit of the invention as set forth in the appended claims.

We claim:

1. In a vehicle door having an interior section defined by a door outer panel and a trim panel, and having a door lock mechanism mounted within the interior section movable between a lock position preventing the door from opening and an unlock position allowing the door to open, a door lock button assembly comprising:

a control rod adapted for mechanical connection on a first end thereof to the door lock mechanism for effecting a change in the door lock mechanism between the lock position and the unlock position when the control rod is moved between a first position and a second position, respectively;

a button member adapted to extend outwardly from the interior section through an opening in the trim panel to allow an operator to grasp a surface thereof to move the control rod between the first and second positions, the control rod pendulumingly mounted on a second end thereof to the button member so as to permit a predetermined angle of swivel with respect to the button member; and the button member having a sleeve extending therefrom with a frusto-conically shaped groove therethrough for receiving a portion of the second end of the control rod therein, the groove having a narrower end placed toward the button member so as to allow the control rod to swivel through the predetermined angle there.

2. A door lock button assembly according to claim 1, wherein said predetermined angle is approximately between 2° and 5°.

3. A door lock button assembly according to claim 1 wherein the button member is journally attached to the control rod to allow the button member to rotate around the longitudinal axis of the control rod so as to prevent binding with the opening when moving therethrough.

4. A door lock button assembly according to claim 3 wherein the button member comprises:

a button portion partially protruding from the opening in the trim; and a shoulder portion having a cavity therein with an orifice leading thereto.

5. A door lock button assembly according to claim 4 wherein the control rod is journally and pendulumingly mounted to the button member via a retainer on the second end of the control rod fitted in the cavity in a ball-and-joint fashion.

6. A door lock button assembly according to claim 5 wherein the retainer comprises a frusto-conically shaped member with a base having a diameter larger than the diameter of the control rod connected to the second end thereof, the orifice having a circumference less than the circumference of the base so as to prevent the retainer from passing therethrough.

7. In a vehicle door having an interior section defined by a door outer panel and a trim panel, and having a door lock mechanism mounted within the interior section movable between a lock position preventing the door from opening and an unlock position allowing the door to open, a door lock button assembly comprising:

a control rod having a first end adapted for mechanical connection to the door lock mechanism for effecting a change in the door lock mechanism between the lock position and the unlock position when the control rod is moved between a first position and a second position, respectively, and a second end with a retainer thereon;

a grommet adapted to fit into an opening in the trim panel; and a button member partially protruding outwardly from the interior section through the grommet and having:

(a) a shoulder portion having a cavity for receiving the retainer therein in non-threading relationship so as to permit the control rod to pendulumingly pivot a predetermined angle with respect thereto and to allow the button member to rotate around the longitudinal axis of the control rod so as to prevent binding with the grommet when moving therethrough;

(b) a sleeve extending from the shoulder with a frusto-conically shaped groove therethrough for receiving a portion of the second end of the control rod therein, a narrower end of the groove oriented toward the cavity so as to allow the control rod to pivot about the retainer; and (c) a button portion to allow an operator to grasp a surface thereof to move the control rod between the first and second positions.

8. A door lock button assembly according to claim 7 wherein the sleeve has a longitudinal slot extending therealong with a width less than the diameter of the control rod and said shoulder has an orifice leading to said cavity so that the control rod and the retainer attach thereto in snap-fit relationship.

9. A door lock button assembly according to claim 8 wherein the retainer comprises a frusto-conically shaped member with a base having a circumference larger than both the circumference of the control rod and the circumference of the narrower end of the groove so as to prevent the retainer from passing therethrough.

10. A door lock button assembly according to claim 7 wherein said predetermined angle is approximately between 2°and 5°.

11. In a vehicle door having a door lock mechanism mounted therein movable between a lock position preventing the door from opening and an unlock position allowing the door to open, said vehicle door having a trim panel mounted on an inner side thereof, a door lock button assembly comprising:

control means adapted for mechanical connection that is connected on a first end thereof to said door lock mechanism for effecting a change in said door lock mechanism between said lock position and said unlock position when said control means is moved between a first position and a second position, respectively;

button means adapted to extend through an opening inset trim panel for moving the control means between the first and second positions; and connection means for non-threadingly attaching the button means to the control means and for allowing rotational movement of the button means around a longitudinal axis of the control means and for preventing the button means from binding when moving through the opening in said trim panel.

* * * * *